US005641364A

United States Patent [19]

Golberg et al.

[11] Patent Number: 5,641,364

[45] Date of Patent: Jun. 24, 1997

[54] METHOD OF MANUFACTURING HIGH-TEMPERATURE SHAPE MEMORY ALLOYS

[75] Inventors: Dmitrii Victorovich Golberg; Kazuhiro Otsuka, both of Tsukuba; Tatsuhiko Ueki, Tokyo; Hiroshi Horikawa, Tokyo; Kengo Mitose, Tokyo, all of Japan

[73] Assignee: The Furukawa Electric Co., Ltd., Japan

[21] Appl. No.: 549,319

[22] Filed: Oct. 27, 1995

[30] Foreign Application Priority Data

Oct. 28, 1994 [JP] Japan ..... 6-265611

[51] Int. Cl.[6] ..... C22C 1/02; C22F 1/16

[52] U.S. Cl. ..... 148/563; 148/402

[58] Field of Search ..... 148/402, 563, 148/407, 409, 421, 426

[56] References Cited

U.S. PATENT DOCUMENTS

| | | | |
|---|---|---|---|
| 4,865,663 | 9/1989 | Tuominen et al. | 148/402 |
| 4,935,068 | 6/1990 | Duerig | 148/563 |
| 5,114,504 | 5/1992 | AbuJudom et al. | 148/402 |

FOREIGN PATENT DOCUMENTS

| | | | |
|---|---|---|---|
| 62-60836 | 3/1987 | Japan . | |
| 62-284047 | 12/1987 | Japan | 148/563 |

*Primary Examiner*—George Wyszomierski
*Attorney, Agent, or Firm*—Lorusso & Loud

[57] ABSTRACT

A method of manufacturing a high-temperature shape memory alloy includes the steps of cold-working a high-temperature shape memory alloy, in which a reverse martensite transformation start temperature (As) in a first heating after cold working reaches 350° C. or above. Thereafter, the cold-worked alloy undergoes a first heat treatment for a period of time within the incubation time required for recrystallization or less, and at a temperature higher than a reverse martensite transformation finish temperature (Af). Finally, the resultant alloy is annealed with a second heat treatment, at a temperature which is not less than the plastic strain recovery temperature and not more than the recrystallization temperature. Specifically, the first heat treatment is performed for a period of three minutes or less at a temperature which exceeds 500° C. and which is lower than the melting point of the alloy. The composition of the high-temperature shape memory alloy is $Ti_{50}Ni_{50-x}Pd_x$ (x being 35 to 50 at %), $Ti_{50-x}Ni_{50}Zr_x$ (x being 22 to 30 at %), $Ti_{50-x}Ni_{50}Hf_x$ (x being 20 to 30 at %) or the like.

3 Claims, No Drawings

METHOD OF MANUFACTURING HIGH-TEMPERATURE SHAPE MEMORY ALLOYS

BACKGROUND OF THE INVENTION

1. Field of the Invention

This invention relates to a method of manufacturing high-temperature shape memory alloys, and more particularly, to a manufacturing method for substantially improving shape recovery characteristics of high-temperature shape memory alloys such as Ti—Pd—Ni, Ti—Ni—Zr and Ti—Ni—Hf alloys.

2. Description of the Prior Art

Ti—Ni alloys are well known as shape memory alloys and superelastic alloys. Shape recovery temperature (i.e., reverse martensite transformation finish temperature, which will hereafter be referred to as "Af temperature") can be varied in the range of approximately −100° to +100° C., depending on the ratio of Ti to Ni, by addition of a third element and by varying conditions of thermo-mechanical treatment or the like.

In the shape memory treatment, these shape memory alloys are cold-worked and thereafter annealed at a temperature (approximately 400° C. in general) which is not less than a plastic strain recovery temperature. The plastic strain recovery temperature corresponds to a temperature at which dislocations induced by cold working are rearranged. Since the plastic strain recovery temperature is higher than the Af temperature, the shape memory alloys are heated up to the Af temperature or above simultaneously with annealing for the shape memory treatment and then transformed to a parent phase state once to permit the memory of shape.

It is important for the shape memory treatment to satisfy the following three conditions for obtaining satisfactory shape memory characteristics. 1) Saturation of reorientation of martensite variants due to cold working should be settled. 2) Dislocations induced by cold working should be rearranged. 3) No recrystallization should be caused.

The Af temperature (shape recovery temperature) of Ti—Ni shape memory alloys slightly exceeds 100° C. at most. Thus, in order to obtain shape memory alloys having an Af temperature higher than 100° C., i.e., high-temperature shape memory alloys, it is necessary to substitute different kinds of alloys such as Ti—Ni—Pd and Ti—Ni—Zr alloys for Ti—Ni alloys.

The high-temperature shape memory alloys can be used for components operated by detection of the boiling of water, the overheating of oil and the melting of a polymer or the like, or for safety valves for cooling water in nuclear reactors.

A large number of alloys such as Ti—Pd—X, Ti—Au—X (X=Ni, Cu, W, Ta, Co, Cr, Fe) and Ti—Ni—X (X=Zr, Hf) alloys are well known as high-temperature shape memory alloys, in which the Af temperature greatly exceeds 100° C. These alloys can vary in reverse martensite transformation start temperature (hereafter referred to as "As temperature") or in Af temperature, depending on the kind of substituent element and the composition range thereof. The As or Af temperature may reach 500° C. or above depending on the composition.

In general, a difference between the As temperature and the Af temperature in an annealing state is not more than several multiples of ten degrees. However, when these alloys are cold-worked, the Af temperature in the first heating after cold working further rises by approximately 150° C. due to induction of strain or deformation and, therefore, the difference between the As temperature and the Af temperature widens. Thus, in case of alloys in which the As temperature is not less than 350° C., the Af temperature in the first heating after cold working reaches 500° C. or above, exceeding recrystallization temperature.

For instance, where the composition of a Ti—Ni—Pd alloy is $Ti_{50}Ni_{50-x}Pd_x$ (a numerical value represents at %, and the same shall apply hereafter), when x is 43 or more, the Af temperature in the annealing state reaches 500° C. or more. Further, when x is 35 or more, the As temperature is not less than 350° C., and the Af temperature in the first heating after cold working reaches 500° C. or above.

In case where the Ti—Ni—Zr alloy has a composition expressed as $Ti_{50-x}Ni_{50}Zr_x$, when x is 29 or more, the Af temperature in the annealing state reaches 500° C. or above.

When x is 22 or more, the As temperature is not less than 350° C., and the Af temperature in the first heating after cold working reaches 500° C. or above.

Further, in case where the Ti—Ni—Hf alloy has a composition expressed as $Ti_{50-x}Ni_{50}Hf_x$, when x is 27 or more, the Af temperature in the annealing state reaches 500° C. or above. Further, when x is 20 or more, the As temperature is not less than 350° C., and the Af temperature in the first heating after cold working reaches 500° C. or above.

As described above, in case of the alloys in which the As temperature is not less than 350° C., the Af temperature in the first heating after cold working reaches 500° C. or above, exceeding recrystallization temperature. As a matter of course, in case of alloys in which the As temperature is not less than 500° C. from the beginning, the Af temperature in the first heating after cold working is also not less than 500° C.

However, even if such alloys described above are cold-worked and thereafter annealed at 400° C. for an hour, similar to the conventional Ti—Ni shape memory alloys, it is not possible to cause the memory of shape.

On the other hand, when the above alloys are annealed at a temperature higher than the Af temperature in the first heating after cold working, it is possible to produce shape memory. However, since the recrystallization starts for the above alloys at such a high temperature, the shape recovery rate is reduced.

For the reasons described above, the high-temperature shape memory alloys, in which the Af temperature in the first heating after cold working reaches a recrystallization temperature or above, have presented a problem in that a satisfactory shape recovery cannot be obtained.

As a result of various studies of the above problems, the present inventors have developed a manufacturing method in which a high-temperature shape memory alloy exhibits an As temperature in the first heating after cold working of not less than 350° C., and is imparted with shape memory and a satisfactory shape recovery rate.

SUMMARY OF THE INVENTION

According to the present invention, there is provided a method of manufacturing a high-temperature shape memory alloy, comprising the steps of cold-working a high-temperature shape memory alloy, in which a reverse martensite transformation start temperature (As) in the first heating after cold working reaches 350° C. or above, thereafter heating the cold-worked alloy in a first heat treatment for a period of time not exceeding the incubation time required for recrystallization and at a temperature higher than a reverse martensite transformation finish temperature (Af), and finally annealing the resultant alloy in a second heat treatment at a temperature which is not less than the plastic strain recovery temperature and not more than the recrystallization temperature.

In a preferred embodiment of the present invention the first heat treatment is performed for a period of three minutes or less at a temperature which exceeds 500° C. and which is less than the melting point of the alloy.

In another preferred aspect of the present invention the composition of the high-temperature shape memory alloy is $Ti_{50}Ni_{50-x}Pd_x$, in which x is in the range of 35 to 50 at %, $Ti_{50-x}Ni_{50}Zr_x$, in which x is in the range of 22 to 30 at %, or $Ti_{50-x}Ni_{50}Hf_x$, in which x is in the range of 20 to 30 at %.

Hereafter will be described the present invention in detail. First of all, a general principle of shape memory treatment of shape memory alloys will be given as follows.

Crystal dislocations are induced at high density by cold working. The resultant cold-worked alloy is then annealed for a proper period of time and at a proper temperature, higher than a plastic strain recovery temperature, to cause rearrangement of the dislocations. Since the rearranged dislocations offer resistance to slip, the critical stress for the slip is increased more than the critical stress for the rearrangement of martensite or for the appearance of stress-induced martensite. Thus, the martensite is rearranged or the stress-induced martensite appears without causing any slip at the time of deformation to produce satisfactory shape memory characteristics.

On the other hand, when the annealing temperature is at the recrystallization temperature or above, not only are the dislocations rearranged, but also recrystallization is caused. Since a recrystallized portion has an extremely reduced density of dislocations, the resistance to the slip is reduced. Therefore, the critical stress for the slip is reduced more than the critical stress for the rearrangement of martensite, and the slip is easily caused, resulting in degradation of shape memory characteristics.

In case of the conventional Ti—Ni shape memory alloys, since the Af temperature (−100° to 100° C.) is not more than the plastic strain recovery temperature (approximately 400° C.), the transformation to a parent phase state occurs due to heating up to the plastic strain recovery temperature or above. Accordingly, the rearrangement of dislocations caused by cold working is attained. Therefore, the conventional Ti—Ni shape memory alloys permit the memory of shape, and have no problem.

However, in case of Ti—Pd—X, Ti—Au—X, Ti—Ni—X or like shape memory alloys, in which the Af temperature is higher than the recrystallization temperature, when the annealing is performed at a temperature exceeding the Af temperature, recrystallization is caused to degrade the shape recovery characteristics. On the other hand, when the annealing is performed at a temperature less than the Af temperature, the above shape memory alloys retain the dislocations of martensite structure caused by cold working even after the heat treatment, and therefore, shape memory cannot be attained.

According to the present invention, a high-temperature shape memory alloy, in which As temperature in the first heating after cold working reaches 350° C. or above, i.e., Ti—Pd—X, Ti—Au—X, Ti—Ni—X or like alloy described above, is cold-worked and thereafter heated as the first heat treatment for a period of time equal to the incubation time for recrystallization or less, at a temperature higher than the Af temperature.

The crystal structure of the alloy is transformed to the parent phase by the first heat treatment.

Once the crystal structure of the alloy is transformed to the parent phase, the dislocations in the martensite caused by cold working can be reoriented.

The temperature in the heat treatment described above is set to be not less than the recrystallization temperature of the alloy. However, since the transformation to the parent phase is finished within the incubation time for recrystallization, the heat treatment for a short period of time is sufficient to heat to the Af temperature or above, and the start of recrystallization can be avoided.

In other words, the first heat treatment of the present invention is performed at a temperature higher than both the Af temperature and the recrystallization temperature. However, since the heating time in the first heat treatment is as extremely short, i.e. equal to the incubation time for recrystallization or less, a shape memory alloy having a high shape recovery rate can be obtained without causing recrystallization.

The temperature in the first heat treatment preferably exceeds 500° C. and is less than the melting point of the alloy. When the temperature is less than 500° C., the shape recovery rate is reduced. On the other hand, when the temperature exceeds the melting point, the alloy is melted. A temperature in the range of 500° to 1000° C. is preferable for practical use.

The melting point of Ti—Au—Ni alloy is approximately in the range of 1310° to 1495° C., the melting point of Ti—Ni—Pd alloy is approximately in the range of 1310° to 400° C., the melting point of Ti—Ni—Zr alloy is approximately in the range of 1260° to 1310° C., and the melting point of Ti—Ni—Hf alloy is approximately in the range of 1310° to 1530° C.

The recrystallization temperature of each of the above alloys is not less than 500° C.

The heating time in the first heat treatment is preferably set to be three minutes or less. When the heating time exceeds three minutes, recrystallization degrades the shape recovery characteristics. More preferably, the heating time is one minute or less.

After the first heat treatment, the annealing is performed as the second heat treatment at a temperature which is not less than the plastic strain recovery temperature of the alloy and not more than the recrystallization temperature. The second heat treatment causes only the rearrangement of dislocations without recrystallization. Therefore, satisfactory shape memory effects can be obtained by the second heat treatment.

The second heat treatment is preferably performed at a temperature of 300° to 500° C. for 30 minutes to 2 hours. When the temperature is less than 300° C., it is not possible to satisfactorily produce shape memory. On the other hand, when the temperature is not less than 500° C., recrystallization is liable to occur.

The high-temperature shape memory alloy to be manufactured according to the present invention corresponds to an alloy in which the As temperature in the first heating after cold working reaches 350° C. or above, i.e., a shape memory alloy recovering at a temperature as high as 350° C. or above. At present, the Ti—Pd—X, Ti—Au—X (X=Ni, Cu, W, Ta, Co, Cr, Fe), and Ti—Ni—X (X=Zr, Hf) alloys described above are representative of such high-temperature shape memory alloys. In particular, the Ti—Pd—X and Ti—Ni—X alloys are of practical use. From the viewpoint of composition, alloys having the compositions respectively expressed as Ti50Ni50 XPdx, in which x is in the range of 35 to 50 at %, Ti50 Ni50Zrx, in which x is in the range of 22 to 30 at %, and Ti50 XNi50Hfx, in which x is in the range of 20 to 30 at %, show satisfactory characteristics and are preferable for practical use.

These high-temperature shape memory alloys can be manufactured according to a conventional method. For instance, a billet is manufactured by means of high frequency induction melting, plasma melting, powder metallurgy or the like. Subsequently, the billet thus manufactured is hot-worked by means of hot rolling, hot extrusion or the like, and then cold-worked by means of cold rolling, drawing or the like and thereby formed into a sheet, strip, rod, wire or like product.

An ordinary heating furnace may be used in the heat treatment. High frequency heating, annealing by direct current or the like can be applied for the heat treatment. Also, air cooling, water quenching or the like can be properly used for cooling after annealing.

DESCRIPTION OF THE PREFERRED EMBODIMENTS (Embodiment 1)

An alloy having a composition expressed as $Ti_{50}Ni_{50-x}Pd_x$ was used to prepare three samples varying in concentration of Pd such that x was 35, 40 and 50 at %, respectively. 30 g of each sample was melted by means of plasma melting and worked into a sheet 1.0 mm in thickness through hot rolling and cold rolling (cold-rolling work rate: approximately 25%). A tension test piece (of 16 mm in gauge length) was cut off from the sheet by means of electric discharge machining. The surface of each test piece was polished and, thereafter, each test piece was heat-treated at the various temperatures shown in Table 1.

A test for shape recovery characteristics was given to each test piece. The results are shown in Table 1.

With respect to test pieces retaining approximately 3% of apparent plastic strain resulting from the removal of stress after 4% of tensile strain has been applied to the test pieces at room temperature, the evaluation was made as follows. The above test pieces were heated up to the shape recovery test temperature shown in Table 1 to cause reverse transformation. The test pieces which showed an almost 100% shape recovery are represented by ○ (i.e., the shape recovery rate was not less than 95%), the test pieces which showed hardly any recovery of shape are represented by X (i.e., the shape recovery was not more than 20%), and the test pieces intermediate between the test pieces represented by ○ and X are represented by Δ.

In Table 1, the As temperature in the first heating represents a reverse martensite transformation start temperature after cold working. In this case, the As temperature was determined by thermal analysis.

In the heat treatment temperatures, Tf represents the temperature in the first heat treatment, and the time the test pieces were held at Tf was one minute, while Ta represents the temperature in the second heat treatment, and the time the test pieces were held at Ta was one hour.

TABLE 1

| | Pd | REVERSE TRANSFORMATION START | HEAT | | SHAPE RECOVERY CHARACTERISTICS | | |
|---|---|---|---|---|---|---|---|
| | CONCENTRATION X | TEMPERATURE IN FIRST HEATING | TREATMENT TEMPERATURE | | SHAPE RECOVERY | RECOVERY | |
| NO. | (at %) | As (°C.) | Tf (°C.) | Ta (°C.) | TEST TEMP. (°C.) | RATE | REMARKS |
| 1 | 35 | APPROX. 350 | 500 | 400 | 380 | ○ | PRESENT INVENTION |
| 2 | " | " | — | 400 | " | X | COMPARATIVE EXAMPLE |
| 3 | " | " | — | 500 | " | Δ | COMPARATIVE EXAMPLE |
| 4 | " | " | — | 900 | " | Δ | COMPARATIVE EXAMPLE |
| 5 | " | " | 600 | 400 | " | ○ | PRESENT INVENTION |
| 6 | 40 | APPROX. 520 | 570 | 400 | 460 | ○ | PRESENT INVENTION |
| 7 | " | " | — | 400 | " | X | COMPARATIVE EXAMPLE |
| 8 | " | " | — | 900 | " | Δ | COMPARATIVE EXAMPLE |
| 9 | " | " | 600 | 400 | " | ○ | PRESENT INVENTION |
| 10 | 50 | APPROX. 670 | 730 | 400 | 620 | ○ | PRESENT INVENTION |
| 11 | " | " | — | 400 | " | X | COMPARATIVE EXAMPLE |
| 12 | " | " | — | 900 | " | Δ | COMPARATIVE EXAMPLE |

As is apparent from Table 1, it was found that each of the test pieces Nos. 1, 5, 6, 9 and 10 showed not less than 350° C. in As temperature in the first heating after cold working and showed an almost 100% shape recovery.

On the other hand, it was found that each of the test pieces Nos. 2, 3, 4, 7, 8, 11 and 12 of the comparative examples hardly showed any recovery of shape, or was inferior in shape recovery, because the first heat treatment (Tf) was omitted.

(Embodiment 2)

With respect to the samples of 35 and 40, the at % in concentration of Pd, the temperatures (Tf, Ta) and time of heat treatment were varied as shown in Table 2 to prepare different samples. The shape recovery characteristics were examined as in embodiment 1, and the results are shown in Table 2.

TABLE 2

| | Pd | HEAT | | | | | SHAPE RECOVERY CHARACTERISTICS | | |
|---|---|---|---|---|---|---|---|---|---|
| | CONCEN-TRATION | TREATMENT TEMPERATURE | | HOLDING TIME (min.) | | PRESENCE OF RECRYSTALLI- | SHAPE RECOVERY | RECOVERY | |
| NO. | X (at %) | Tf (°C.) | Ta (°C.) | Tf | Ta | ZATION | TEST TEMP. (°C.) | RATE | REMARKS |
| 1 | 35 | 500 | 400 | 1 | 60 | ABSENCE | 380 | ○ | PRESENT INVENTION |
| 2 | " | 600 | 400 | 2 | 60 | ABSENCE | " | ○ | PRESENT INVENTION |
| 3 | " | 600 | 400 | 10 | 60 | PRESENCE | " | Δ | COMPARATIVE EXAMPLE |
| 4 | 40 | 570 | 400 | 1 | 60 | ABSENCE | 460 | ○ | PRESENT INVENTION |
| 5 | " | 600 | 400 | 30 (sec.) | 60 | ABSENCE | " | ○ | PRESENT INVENTION |
| 6 | " | 600 | 400 | 10 | 60 | PRESENCE | " | Δ | COMPARATIVE EXAMPLE |

As is apparent from Table 2, each of the test pieces Nos. 1, 2, 4 and 5 of the present invention shows satisfactory shape recovery characteristics without recrystallization. In this case, as long as the time the test pieces are held at Tf is within 2 minutes, the first heat treatment can be performed within the incubation time of recrystallization, even if Tf exceeds the recrystallization temperature.

On the other hand, each of the test pieces Nos. 3 and 6 of the comparative examples underwent recrystallization and was inferior in shape recovery characteristics, because these test pieces were held at Tf for a longer period of time.

(Embodiment 3)

An alloy having a composition expressed as $Ti_{50-x}Ni_{50}Zr_X$ was used to prepare two kinds of samples varying in concentration of Zr, with x being 22 and 30 at %, respectively. 3 Kg of each sample was melted by means of high frequency induction melting, and then subjected to casting, hot-extrusion and hot-rolling with a grooved roll. Subsequently, the resultant samples were repeatedly drawn with a die, annealed and worked into a wire of 1.0 mm in diameter (final cold working rate: approximately 30%). 140 mm of the rod was cut off, then linearly fixed in position and heat-treated at the various temperatures shown in Table 3.

A test for shape recovery characteristics was given to each test piece. The results are shown in Table 3.

A strain gauge of 50 mm in length between gauges was used for applying tensile strain. The evaluation method, the heat-treatment method and the symbols in Table 3 are similar to those in embodiment 1.

TABLE 3

| | Zr | REVERSE TRANSFORMATION START | HEAT | | SHAPE RECOVERY CHARACTERISTICS | | |
|---|---|---|---|---|---|---|---|
| | CONCENTRATION X | TEMPERATURE IN FIRST HEATING | TREATMENT TEMPERATURE | | SHAPE RECOVERY | RECOVERY | |
| NO. | (at %) | As (°C.) | Tf (°C.) | Ta (°C.) | TEST TEMP. (°C.) | RATE | REMARKS |
| 1 | 22 | APPROX. 350 | 600 | 450 | 380 | ○ | PRESENT INVENTION |
| 2 | " | " | — | 400 | " | X | COMPARATIVE EXAMPLE |
| 3 | " | " | — | 600 | " | Δ | COMPARATIVE EXAMPLE |
| 4 | 30 | APPROX. 500 | 700 | 400 | 530 | ○ | PRESENT INVENTION |
| 5 | " | " | — | 400 | " | X | COMPARATIVE EXAMPLE |
| 6 | " | " | — | 700 | " | Δ | COMPARATIVE EXAMPLE |

As is apparent from Table 3, each of the test pieces Nos. 1 and 4 of the present invention showed not less than 350° C. in As temperature in the first heating, and almost 100% shape recovery. On the other hand, each of the test pieces Nos. 2, 3, 5 and 6 of the comparative examples hardly showed any recovery of shape or was inferior in shape recovery, because the first heat treatment (Tf) was omitted.

(Embodiment 4)

With respect to the samples of 22 and 30, the at % in concentration of Zr, the temperatures (Tf, Ta) and time of heat treatment were varied as shown in Table 4 to prepare different samples. Then, the shape recovery characteristics were examined as in embodiment 3. The results are shown in Table 4.

An alloy having a composition expressed as $Ti_{50-x}N_{50}Hf_x$ was used to prepare two samples varying in concentration of Hf, with x at 20 and 30 at %, respectively. 1 Kg of each sample was formed into a billet by means of powder metallurgy. Subsequently, the billet was subjected to hot isostatic pressing treatment, hot-extrusion and hot-rolling with a grooved roll. Thereafter, the rolled product was repeatedly drawn with a die, annealed and worked into a wire of 1.0 mm in diameter (final cold working rate: approximately 30%). 140 mm of the rod was cut off, then linearly fixed in position and heat-treated at the various temperatures shown in Table 5. A test for shape recovery characteristics was given to each test piece. The results are shown in Table 5.

TABLE 4

| | Zr | HEAT | | | | | SHAPE RECOVERY CHARACTERISTICS | | |
|---|---|---|---|---|---|---|---|---|---|
| | CONCEN-TRATION | TREATMENT TEMPERATURE | | HOLDING TIME (min.) | | PRESENCE OF RECRYSTALLI- | SHAPE RECOVERY | RECOVERY | |
| NO. | X (at %) | Tf (°C.) | Ta (°C.) | Tf | Ta | ZATION | TEST TEMP. (°C.) | RATE | REMARKS |
| 1 | 22 | 600 | 400 | 1 | 60 | ABSENCE | 380 | ○ | PRESENT INVENTION |
| 2 | " | 600 | 400 | 10 | 60 | PRESENCE | " | Δ | COMPARATIVE EXAMPLE |
| 3 | 30 | 700 | 400 | 1 | 60 | ABSENCE | 530 | ○ | PRESENT INVENTION |
| 4 | " | 700 | 400 | 10 | 60 | PRESENCE | " | Δ | COMPARATIVE EXAMPLE |

As is apparent from Table 4, each of the test pieces Nos. 1 and 3 of the present invention showed satisfactory shape recovery characteristics without recrystallization. In this case, as long as the test pieces were held at Af within one minute, the first heat treatment can be performed within the incubation time of recrystallization, even if Tf exceeds the recrystallization temperature.

On the other hand, each of the test pieces Nos. 2 and 4 of the comparative examples underwent recrystallization and were inferior in shape recovery characteristics, because the test pieces were held at Tf for a longer period of time.

(Embodiment 5)

The testing method, the evaluation method, the heat-treatment method and the symbols in Table 5 are similar to those in embodiment 3.

TABLE 5

| | Hf | REVERSE TRANSFORMATION START | HEAT | | SHAPE RECOVERY CHARACTERISTICS | | |
|---|---|---|---|---|---|---|---|
| | CONCENTRATION X | TEMPERATURE IN FIRST HEATING | TREATMENT TEMPERATURE | | SHAPE RECOVERY | RECOVERY | |
| NO. | (at %) | As (°C.) | Tf (°C.) | Ta (°C.) | TEST TEMP. (°C.) | RATE | REMARKS |
| 1 | 20 | APPROX. 350 | 600 | 400 | 390 | ○ | PRESENT INVENTION |
| 2 | " | " | — | 400 | " | X | COMPARATIVE EXAMPLE |
| 3 | " | " | — | 600 | " | Δ | COMPARATIVE EXAMPLE |
| 4 | 30 | APPROX. 600 | 800 | 400 | 640 | ○ | PRESENT INVENTION |
| 5 | " | " | — | 400 | " | X | COMPARATIVE EXAMPLE |
| 6 | " | " | — | 800 | " | Δ | COMPARATIVE EXAMPLE |

As is apparent from Table 5, each of the test pieces Nos. 1 and 4 of the present invention showed not less than 350° C. in As temperature in the first heating, and showed almost 100% shape recovery. On the other hand, each of the test pieces Nos. 2, 3, 5 and 6 of the comparative examples hardly showed any recovery of shape or was inferior in shape recovery, because the first heat treatment (Tf) was omitted.

(Embodiment 6)

With respect to the samples of 20 and 30, the at % in Hf, the temperatures (Tf, Ta) and time of the heat treatment were varied as shown in Table 6 to prepare different samples. Then, the shape recovery characteristics were examined as in embodiment 5. The results are shown in Table 6.

TABLE 6

| | Hf | HEAT | | | | | SHAPE RECOVERY CHARACTERISTICS | | |
|---|---|---|---|---|---|---|---|---|---|
| | CONCEN-TRATION | TREATMENT TEMPERATURE | | HOLDING TIME (min.) | | PRESENCE OF RECRYSTALLI- | SHAPE RECOVERY | RECOVERY | |
| NO. | X (at %) | Tf (°C.) | Ta (°C.) | Tf | Ta | ZATION | TEST TEMP. (°C.) | RATE | REMARKS |
| 1 | 20 | 600 | 400 | 1 | 60 | ABSENCE | 390 | ○ | PRESENT INVENTION |
| 2 | " | 600 | 400 | 10 | 60 | PRESENCE | " | Δ | COMPARATIVE EXAMPLE |
| 3 | 30 | 800 | 400 | 1 | 60 | ABSENCE | 640 | ○ | PRESENT INVENTION |
| 4 | " | 800 | 400 | 10 | 60 | PRESENCE | " | Δ | COMPARATIVE EXAMPLE |

As is apparent from Table 6, each of the test pieces Nos. 1 and 3 of the present invention showed satisfactory shape recovery characteristics without recrystallization. In this case, as long as the time the test pieces were held at Tf was within one minute, the first heat treatment was performed within the incubation time of recrystallization, even where Tf exceeded the recrystallization temperature.

On the other hand, each of the test pieces Nos. 2 and 4 of the comparative examples underwent recrystallization and was inferior in shape recovery characteristics, because the test pieces were held at Tf for a longer period of time.

According to the present invention, it is possible to obtain a high-temperature shape memory alloy which is excellent in shape recovery characteristics. Thus, the high-temperature shape memory alloy of the present invention can be expected to be useful for components operating by detecting the boiling of water, the overheating of oil, and the melting of polymer or the like, or as safety valves for cooling water in nuclear reactors.

What is claimed is:

1. A method of manufacturing a high-temperature shape memory alloy, comprising the steps of:

cold-working a high-temperature shape memory alloy, so that a reverse martensite transformation start temperature (As) of the alloy reaches 350° C. or above and a reverse martensite transformation finish temperature ($A_F$) of the alloy exceeds the recrystallization temperature of the alloy;

thereafter subjecting the cold-worked alloy to a first heat treatment at a first temperature above the recrystallization temperature, for a period of time sufficiently short to prevent the start of recrystallization, said first temperature being higher than the $A_f$ temperature; and then annealing the resultant alloy in a second heat treatment, at a second temperature which is not less than the plastic strain recovery temperature of the alloy and not more than the recrystallization temperature of the alloy.

2. A method of manufacturing a high-temperature shape memory alloy according to claim 1, wherein the first heat treatment is performed for a period of three minutes or less and wherein said first temperature exceeds 500° C. and is less than a melting point of the alloy.

3. A method of manufacturing a high-temperature shape memory alloy according to claim 1, wherein the composition of said high-temperature shape memory alloy is expressed, with numerical values representing at %, as $Ti_{50}Ni_{50-x}Pd_x$, in which X is 35 to 50 at %, $Ti_{50-x}Ni_{50}Zr_x$, in which X is 22 to 30 at %, or $Ti_{50-x}Ni_{50}Hf_x$, in which X is 20 to 30 at %.

* * * * *

UNITED STATES PATENT AND TRADEMARK OFFICE

CERTIFICATE OF CORRECTION

PATENT NO. : 5,641,364

DATED : June 24, 1997

INVENTOR(S) : GOLBERG et al

It is certified that error appears in the above-indentified patent and that said Letters Patent is hereby corrected as shown below:

Col. 4, line 32, "400°" should read --1400°--.

Col. 12, line 39, "$A_f$" should read --$A_F$--.

Signed and Sealed this

Ninth Day of June, 1998

*Attest:*

*Attesting Officer*

Bruce Lehman

BRUCE LEHMAN

*Commissioner of Patents and Trademarks*